United States Patent [19]

Oogami et al.

[11] 4,142,272

[45] Mar. 6, 1979

[54] ADJUSTABLE-POSITION PIVOT MECHANISM FOR PIVOTED WINDOWS

[75] Inventors: Eiryo Oogami; Nobuaki Tsurukawa, both of Kurobe, Japan

[73] Assignee: Yoshida Kogyo K.K., Tokyo, Japan

[21] Appl. No.: 824,253

[22] Filed: Aug. 12, 1977

[30] Foreign Application Priority Data

Aug. 13, 1976 [JP] Japan ..... 51-109090[U]

[51] Int. Cl.[2] ..... E05D 7/04

[52] U.S. Cl. ..... 16/130; 49/390

[58] Field of Search ..... 49/388, 390, 420, 421, 49/425; 16/128, 129–131, 168; 160/206

[56] References Cited

U.S. PATENT DOCUMENTS

| | | | |
|---|---|---|---|
| 2,583,950 | 1/1952 | Kirschner | 16/129 |
| 3,474,572 | 10/1969 | Rothemund | 49/390 |
| 3,584,332 | 6/1971 | Taylor | 16/131 X |
| 4,007,513 | 2/1977 | Zernig | 16/129 X |

FOREIGN PATENT DOCUMENTS

| | | | |
|---|---|---|---|
| 622802 | 5/1949 | United Kingdom | 16/129 |

*Primary Examiner*—Kenneth Downey

*Attorney, Agent, or Firm*—Hill, Gross, Simpson, Van Santen, Steadman, Chiara & Simpson

[57] ABSTRACT

Each of paired pivot mechanisms pivotally holding a window sash within a supporting frame comprises a stationary base screwed to one of the constituent members of the supporting frame and a pivot-carrying movable base fitted over the stationary base. By manipulation of a pair of adjusting screws the movable base can be adjustably moved relatively to the stationary base in the longitudinal direction of the supporting frame member and, if desired, away from or back toward the same. The movable base is screwed to the supporting frame member via the stationary base in a desired position. The mechanism is equally applicable to either vertically or horizontally pivoted windows.

10 Claims, 7 Drawing Figures

ADJUSTABLE-POSITION PIVOT MECHANISM FOR PIVOTED WINDOWS

BACKGROUND OF THE INVENTION

1. Field of the Invention

The present invention relates to an adjustable-position pivot mechanisms for pivoted windows.

2. Prior Art

In a pivoted window assembly, as is well known, the sash is mounted within a supporting frame by means of a pair of pivots for pivotal motion about either a vertical or a horizontal axis. Thus, unless the pivots are located exactly on the vertical or the horizontal axis, the sash cannot be held in such a position relative to the supporting frame as to permit its smooth pivotal motion between closed and open positions.

SUMMARY OF THE INVENTION

It is an object of the present invention to provide an adjustable-position pivot mechanism having a pivot that is easily adjustably movable in the longitudinal direction of a supporting frame member on which the pivot is mounted.

Another object of the present invention is to provide an adjustable-position pivot mechanism having a pivot that is easily adjustably movable away from or back toward the supporting frame member as required.

According to the present invention, an adjustable-position pivot mechanism comprises a stationary base and a movable base placed over the stationary base and constrained to movement relative to the same at least in the longitudinal direction of a supporting frame member to which the stationary base is secured. The movable base carries a pivot which extends therefrom in a direction away from the stationary base for engaging a window sash. Means is included in the pivot mechanism for adjustably moving the movable base relatively to the stationary base at least in the longitudinal direction of the supporting frame member. There is another means for securing the movable base to the supporting frame member via the stationary base in a desired position.

Many other advantages and features of the present invention will become manifest to those versed in the art upon making reference to the detailed description and the accompanying sheets of drawings in which a preferred structural embodiment incorporating the principles of the present invention is shown by way of example.

DESCRIPTION OF THE PREFERRED EMBODIMENT

Figure 1:
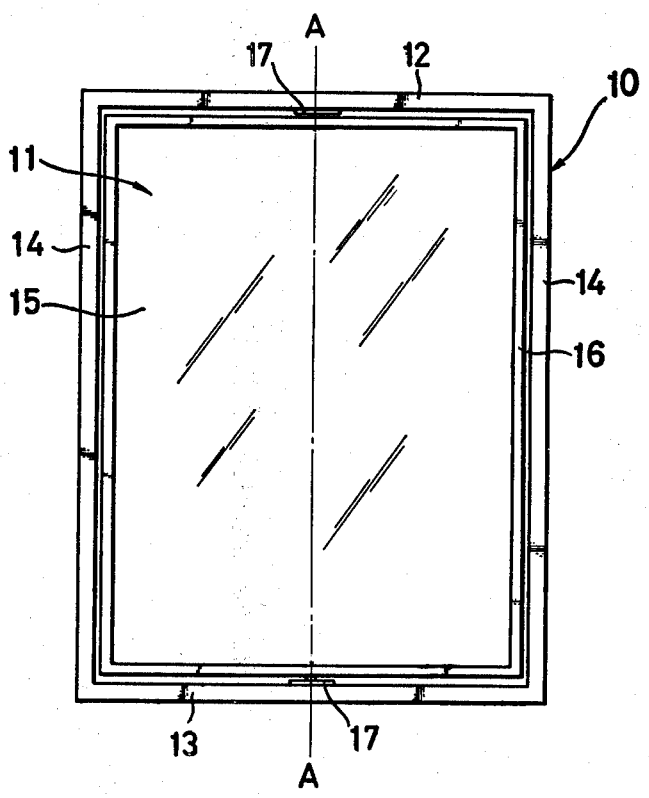
FIG. 1 is a front elevational view of a pivoted window assembly incorporating the adjustable-position pivot mechanisms constructed in accordance with the present invention.

In FIG. 1, a pivoted window assembly comprises a supporting frame 10 and a sash 11 mounted within the supporting frame for pivotal motion about a vertical axis A—A. The supporting frame 10 is mounted in the usual window receiving opening in an enclosing wall (not shown), and comprises a header 12, a sill 13, and side jambs 14,14 which are connected into generally rectangular shape. The window sash 11 comprises a panel or pane 15 of glass or other suitable material, and a frame 16 extending along and embracing the periphery of the panel.

There are a pair of adjustable-position pivot mechanisms 17,17 which jointly hold the sash 11 within the supporting frame 10 for pivotal motion about the vertical axis A—A. The pair of pivot mechanisms 17 are identical in construction, and only one of them that is mounted on the sill 13 is described in detail, the same description being applicable to the other pivot mechanism 17 mounted on the header 12.

Figure 2:
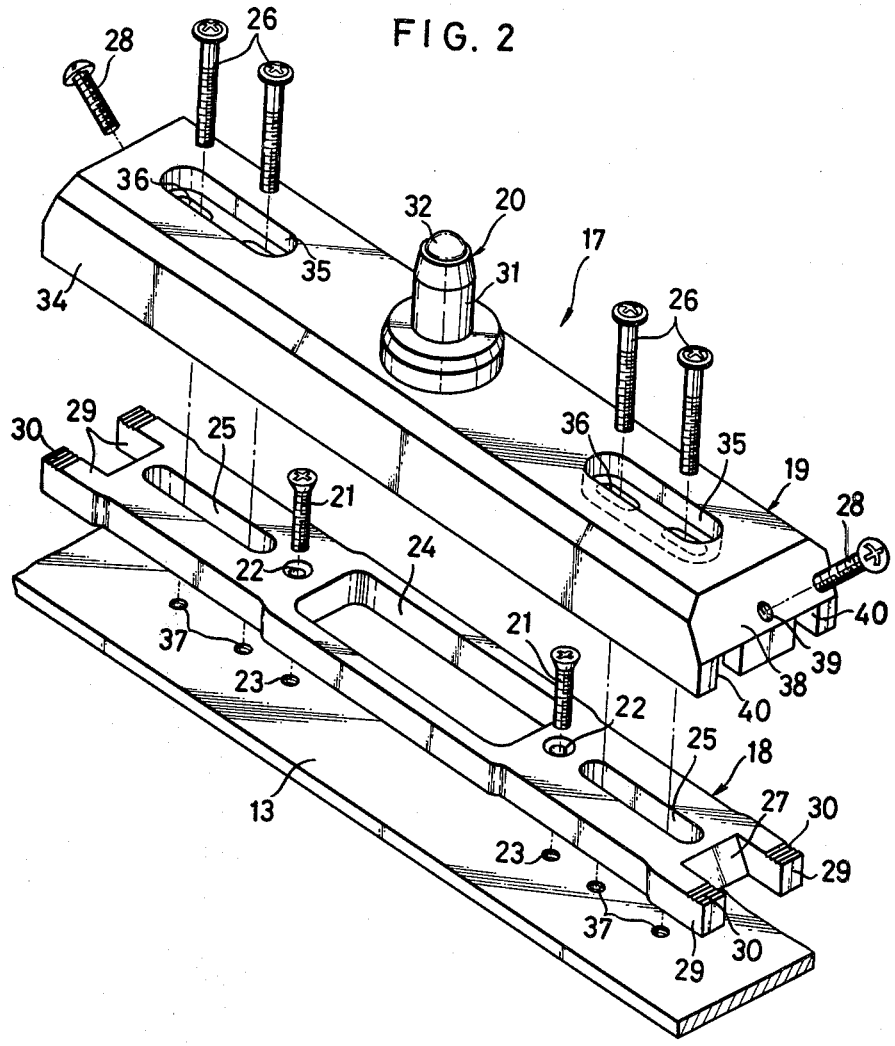
FIG. 2 is an enlarged exploded perspective view of one of the pivot mechanisms used in the window assembly of FIG. 1.

As shown in FIG. 2, the adjustable-position pivot mechanism 17 broadly comprises a stationary base 18 fastened to the sill 13, and a movable base 19 carrying a pivot 20 and fastened to the sill 13 via the stationary base 18 after positional adjustment of the pivot 20 at least in the longitudinal direction of the sill 13.

The stationary base 18 is elongated in the longitudinal direction of the sill 13 and is secured in position thereto by a pair of flathead machine screws 21 extending through a pair of countersunk holes 22,22 in the stationary base and tapped holes 23 in the sill 13. Through the stationary base 18, there is a central guide slot 24 of comparatively great width, the slot 24 extending in the longitudinal direction of the stationary base 18, and therefore of the sill 13, for constraining the movable base 19 to movement at least in the longitudinal direction of the sill 13, as described below in more detail.

A pair of fastener receiving slots 25 of smaller width than that of the guide slot 24 are provided through the stationary base 18 on opposite sides of the guide slot 24, with each fastener receiving slot also extending in the longitudinal direction of the stationary base 18. These fastener receiving slots 25 each permit a pair of threaded fastener elements such as roundhead capscrews 26 to pass therethrough in securing the movable base 19 to the sill 13 via the stationary base 18.

A pair of abutments 27 are provided at opposite ends of the stationary base 18, the abutments 27 being abutted upon by respective threaded elements such as roundhead adjusting machine screws 28 whereby the movable base 19 can be adjustably moved relatively to the stationary base 18 at least in the longitudinal direction of the sill 13. Preferably, the abutments 27 are disposed at an angle to the general plane of the sill 13 in order to permit movement of the movable base 19 away from or back toward the stationary base 18.

Figure 7:
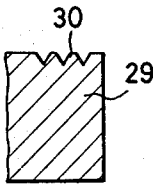
FIG. 7 is an enlarged vertical sectional view of one of the graduated arms of the pivot mechanism.

The stationary base 18 includes a pair of arms or extensions 29 projecting beyond the abutment 27 at each end of the stationary base in parallel spaced relationship to each other. As best illustrated in FIG. 7, the paired arms 29 are each graduated or marked with a series of notches 30 that serve as a scale to permit visual confirmation of the extent of movement of the movable base 19 relative to the stationary base 18 in the longitudinal direction of the sill 13.

Figure 3:
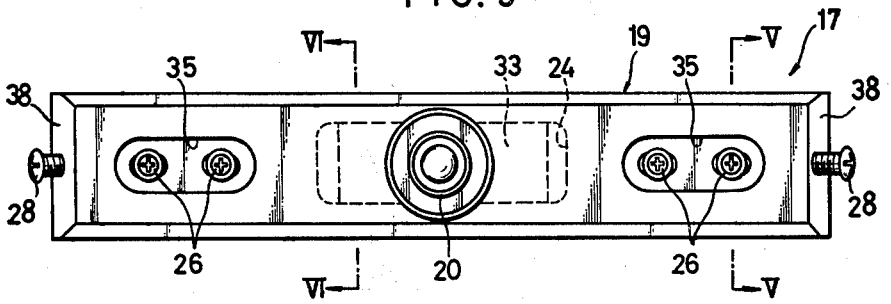
FIG. 3 is a plan view of the pivot mechanism of FIG. 2 in assembled form.
Figure 4:
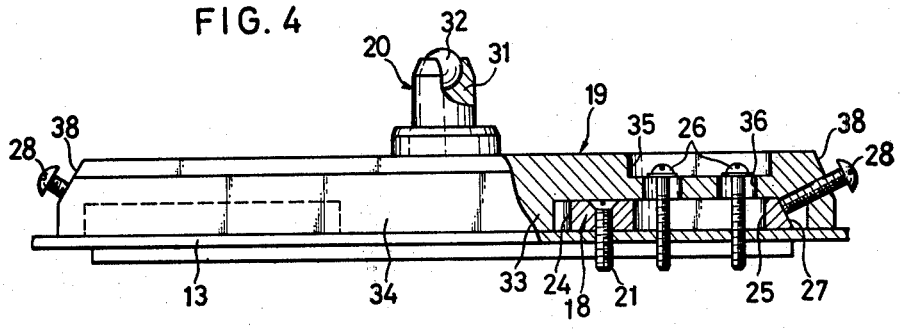
FIG. 4 is a front elevational view, partly in cross-section, of the assembled pivot mechanism.
Figure 5:
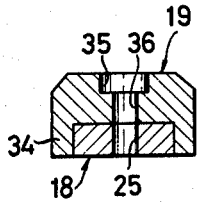
FIG. 5 is a cross-sectional view taken along line V—V of FIG. 3, but the stationary base as well as the capscrew are omitted for clarity.
Figure 6:
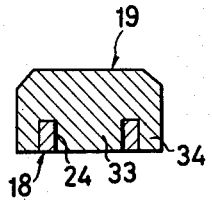
FIG. 6 is a cross-sectional view taken along line VI—VI of FIG. 3, but the stationary base is omitted for clarity.

In FIGS. 2 through 4, the movable base 19 also extends in the longitudinal direction of the sill 13 and is of approximately the same longitudinal dimension as the stationary base 18. The pivot 20 projects from the midpoint of the movable base 19 away from the stationary base 18 and comprises a pedestalled standard 31 erected on the movable base 19 and a ball 32 partly buried in the tip of the standard. This pivot 20 engages the window sash 11 in the usual manner for pivotally supporting same in cooperation with the pivot of the opposite pivot mechanism 17.

A guide boss 33 is provided centrally on the underside of the movable base 19 and fits slidably in the guide slot 24 in the stationary base 18. The movable base 19 is movable longitudinally within limits determined by the lengths of the guide slot 24 and boss 33, and is movable away from or back toward the sill 13.

The movable base 19 further includes a skirt 34 extending along and directed downwardly from the marginal edges of the movable base so as to surround the guide boss 33 with spacings therebetween. When mounted in position over the stationary base 18 as shown in FIGS. 3 and 4, the skirted movable base 19 substantially completely encloses the stationary base thereby protecting the mating surfaces of the stationary and the movable bases from dust and other foreign matter which might impede their relative sliding motion.

On opposite sides of the pivot 20, there are a pair of elongate sinks or depressions 35 provided in the movable base 19, the sinks 35 being substantially in register with the respective fastener receiving slots 25 in the stationary base 18 when the two bases are assembled. A pair of fastener receiving slots 36 are provided in each sink 35 and extend through the movable base 19 so as to be in alignment in the longitudinal direction of the sill 13. The fastener receiving slots 36 receive therethrough the capscrews 26 that are screwed into a pair of tapped holes 37 in the sill 13 through the slots 25 in the stationary base 18 for securing the movable base 19 to the sill.

The movable base 19 has a pair of bevels 38 at its opposite ends in parallel relationship to the respective sloping abutments 27 of the stationary base 18, and tapped holes 39 (FIG. 2) are provided through the bevelled ends of the movable base 19. The adjusting screws 28 pass through the tapped holes 39 in the movable base 19, the screws 28 extending normal to the respective abutments 27 and having their flat points held thereagainst.

The skirt 34 has a pair of recesses 40 at each end of the movable base 19, the recesses 40 slidably receiving the graduated arms 29 of the stationary base 18. The graduated arms 29 are concealed in the respective recesses 40 when the stationary and the movable bases 18 and 19 are disposed in exact register with each other in their longitudinal direction.

For assembling and mounting in position the adjustable-position pivot mechanism 17, the stationary base 18 is first fastened to the sill 13 by a pair of machine screws 21 passing through the holes 22 in the stationary base and the tapped holes 23 in the sill 13. The movable base 19 is then placed over the stationary base 18, and loosely secured thereto by the four capscrews 26. The pair of adjusting screws 28 at both ends of the movable base are manipulated to adjustably move the base 19 relative to the stationary base 18 longitudinally of the sill 13. The extent of movement of the movable base 19 in either direction can be ascertained from the graduations 30 on either pair of arms 29,29.

Such manual adjustment is necessary to locate the pivots 20 of the two pivot mechanisms 17 exactly on the vertical axis A—A about which the window sash 11 is to be pivoted relatively to the supporting frame 10. In the event too much spacing exists between the sash 11 and the sill 13, both of the adjusting screws 28 are tightened to move the pivot 20 away from the sill 13 together with the movable base 19. After the necessary positional adjustment of the pivot 20, the movable base 19 is made fast by tightening the four capscrews 26.

For guiding the movable base 19 in the longitudinal direction of the sill 13, the guide slot 24 may alternatively be provided in the movable base, and the guide boss 33 may be provided on the stationary base. Further, the adjustable-position pivot mechanism of this invention may be employed in combination with a pivot mechanism of any conventional construction for supporting a pivoted window sash for pivotal motion about either a vertical or a horizontal axis.

Although various minor modifications may be suggested by those versed in the art, it should be understood that we wish to embody within the scope of the patent warranted hereon, all such embodiments as reasonably and properly come within the scope of our contribution to the art.

What we claim is:

1. An adjustable-position pivot mechanism for cooperating with another pivot mechanism for pivotally holding a window sash within a supporting frame, comprising in combination:

(a) a stationary base adapted to be secured to one of the constituent members of the supporting frame;

(b) a movable base on said stationary base;

(c) a pivot projecting from said movable base away from said stationary base for engaging the window sash;

(d) guide means constraining said movable base to movement relative to said stationary base in the longitudinal direction of the one supporting frame member within limits;

(e) adjusting means carried by said bases for adjustably moving said movable base relative to said stationary base at least in the longitudinal direction of the one supporting frame member, said adjusting means comprising a pair of abutments at opposite ends of said stationary base, and a pair of threaded elements threadedly extending through respective ends of said movable base into abutting engagement with the respective abutments of said stationary base, said abutments of said stationary base being disposed at an angle to the general plane of the one supporting frame member, and said threaded elements being disposed normal to the respective abutments, whereby said movable base can be adjustably moved away from or back toward said stationary base by said threaded elements and moved in the longitudinal direction of the one supporting frame member; and (f) means for securing said movable base to the one supporting frame member via said stationary base in a desired position of said movable base relative to said stationary base.

2. A pivot mechanism for a movable window sash, such mechanism enabling adjustment between the pivotal axis thereof and a fixed supporting frame, comprising in combination:

(a) a stationary base adapted to be secured at a fixed position on one of the constituent members of the fixed supporting frame;

(b) a movable base movable on said stationary base, there being a pivot, having a pivotal axis, projecting from said movable base away from said stationary base for engaging the movable window sash at a fixed position thereon;

(c) guide means acting between said bases and constraining said movable base to movement relative to said stationary base in the longitudinal direction of the one supporting frame member within limits;

(d) adjusting means carried by said bases for adjustably moving said movable base relative to said stationary base at least in the longitudinal direction of the one supporting frame member; and (e) means for securing said movable base to the one supporting frame member via said stationary base in a desired position of said movable base relative to said stationary base.

3. A pivot mechanism according to claim 2, said adjusting means comprising a pair of flat non-parallel abutments at opposite ends of said stationary base, and a pair of threaded elements threadedly extending through respective ends of said movable base into abutting engagement with the respective abutments of said stationary base.

4. A pivot mechanism according to claim 2, said adjustably movable base including an integral skirt by which said stationary base is substantially completely enclosed in said movable base.

5. A pivot mechanism according to claim 2, said guide means comprising an elongated guide boss on one of said bases, there being a guide slot in the other of said bases slidably receiving said guide boss lengthwise.

6. A pivot mechanism according to claim 5, said elongated guide boss being on said movable base and said guide slot being in said stationary base.

7. A pivot mechanism according to claim 2, said guide means, said adjusting means, and said securing means also enabling guidance and adjustment of said movable base in the direction of said pivotal axis.

8. A pivot mechanism according to claim 5, said pivotal axis intersecting the central portion of said guide boss.

9. A pivot mechanism according to claim 2, said stationary base having a scale portion at least at one end thereof slidable through a recess in the end of said movable base to enable visual confirmation of the extent of longitudinal movement of said movable base relative to said stationary base.

10. A pivot mechanism according to claim 2, said movable base including an integral peripheral skirt movable with it and extending around the periphery of said stationary base toward the one supporting frame member.

* * * * *